United States Patent [19]

Nakamura

[11] Patent Number: 4,950,947

[45] Date of Patent: Aug. 21, 1990

[54] CATHODE RAY TUBE CONTAINING AN ANODE WHICH YIELDS MINIMAL X-RAY EMISSION

[75] Inventor: Koji Nakamura, Nagaokakyo, Japan

[73] Assignee: Mitsubishi Denki Kabushiki Kaisha, Kyoto, Japan

[21] Appl. No.: 267,562

[22] Filed: Nov. 7, 1988

[30] Foreign Application Priority Data

Nov. 7, 1987 [JP] Japan ..... 62-281712

[51] Int. Cl.[5] ..... H01J 29/90; H01R 13/648

[52] U.S. Cl. ..... 313/477 HC; 313/477 R; 313/479; 313/318; 439/613

[58] Field of Search ..... 313/477 R, 477 HC, 479, 313/318; 439/613

[56] References Cited

U.S. PATENT DOCUMENTS 3,626,232 12/1971 Ohgoshi et al. ..... 313/477 HC X 3,969,647 7/1976 Keen et al. ..... 313/477 HC

*Primary Examiner*—Kenneth Weider

[57] ABSTRACT

A cathode ray tube includes a highly evacuated envelope including a funnel section having one end closed by a faceplate and the opposite end continued to a generally tubular neck section. An internal electroconductive coating is applied to an inner surface of at least the funnel section. Further, an anode button is embedded in a mounting hole defined in the wall of the envelope forming the funnel section and is connected electrically with the internal electroconductive coating. The anode button, embedded in the hole in the wall forming the funnel section, has a circumferentially extending side wall inclined relative to a direction generally parallel to a portion of the envelope confronting the interior of the envelope in alignment with the mounting hole. At least a portion of the inclined circumferentially extending side wall of the anode button is held in electrical contact with the internal electroconductive coating on the inner surface of the funnel section.

22 Claims, 8 Drawing Sheets

CATHODE RAY TUBE CONTAINING AN ANODE WHICH YIELDS MINIMAL X-RAY EMISSION

BACKGROUND OF THE INVENTION

1. Field of the Invention

The present invention generally relates to a cathode ray tube for use in, for example, a television receiver set, a computer terminal monitor display or the like. More particularly, to the cathode ray tube of a type having an anode button embedded in a funnel section of an envelope of the cathode ray tube for electric connection with an internal electroconductive coating disposed on the internal surface of at least the funnel section of the envelope.

2. Description of the Prior Art

As shown in FIG. 1 of the accompanying drawings, which illustrates a popular color cathode ray tube (a side view with a portion cut away), the well-known color cathode ray tube comprises a highly evacuated envelope 1 including a generally conical funnel section 3 having a large-sized end closed by a faceplate 2 and a small-sized end continued to a generally cylindrical neck section 4. It further contains an electron gun assembly 13 housed within the neck section 4 at one end thereof opposite to the funnel section 3. The faceplate 2 has an inner surface deposited with a luminescent phosphor screen 5 formed of a predetermined pattern of primary color elemental phosphor deposits, for example, triads of red, blue and green phosphor dots.

The cathode ray tube also comprises a color selection electrode or shadow mask 6 which is a perforated thin metal foil having a predetermined pattern of apertures which can be triads of minute circular holes. Which the pattern corresponds to the pattern of the primary color elemental phosphor deposits on the luminescent phosphor screen 5. This shadow mask 6 is supported by a frame structure 7 which is also used to secure the shadow mask immovably inside the faceplate 2 while spaced a predetermined distance from the luminescent phosphor screen 5. On one side of the shadow mask 6, opposite to the luminescent phosphor screen 5, an internal magnetic shield 9 is secured to and supported by the frame structure 7 within the funnel section 3, for shielding the interior of the envelope 1 from an adverse influence which may be brought about by an external magnetic field such as originating from, for example, terrestrial magnetism.

At least the funnel section 3 has its inner surface deposited with an internal electroconductive coating 8 which is formed by applying a paint of graphite to the inner surface thereof. This internal electroconductive coating 8 is electrically connected with the frame structure 7 through an elastic electroconductive member 10, which may be a metal leaf spring. It has one end secured to the frame structure 7 and the other end held in contact with the internal electroconductive coating 8. This elastic electroconductive member 10 serves to feed a high voltage of, for example, 20 to 30 Kv, applied from an external power source to the internal electroconductive coating 8, to the shadow mask 6 through the frame structure 7. The supply of the high voltage, from the external power source to the internal electroconductive coating 8 and then to the shadow mask 6 through the elastic electroconductive member 10 and also through the frame structure 7, is carried out through a generally cup-shaped anode button 11 made of electroconductive material. The details of the button 11 will now be described with particular reference to FIG. 2 illustrating the anode button 11, in a side sectional view representation in an enlarged scale.

According to the prior art, as best shown in FIG. 2, the anode button 11 is tightly inserted in a mounting hole **3*a* defined in the funnel section 3 of the cathode ray tube and extending completely through the thickness of the wall of the funnel section 3. This anode button 11 is of a generally cup-like configuration, as hereinbefore described, having a bottom wall 11*b* held in contact with the internal electroconductive coating 8 when, and so long as, the anode button 11 is fitted into the mounting hole 3*a*. The anode button 11 also has an opening 11*a* defined therein in opposition to the bottom 11*b* thereof for receiving therein, a forked contact element 12 (See FIG. 1). The element 12 is utilized for the application of the high voltage from the external power source to the internal electroconductive coating 8 through the anode button 11**.

The anode button 11 illustrated in FIG. 2 is prepared into the generally cup-like configuration by the use of a press work from a metallic plate having a thickness of, for example, 0.45 in thickness and made of, for example, Fe-Ni-Cr alloy. Within the anode button 11, a retaining ring member 14, having a connector opening **14*a* defined therein, is accommodated and integrated with the anode button 11 such that the forked contact element 12 shown in FIG. 1 can be detachably engaged, in a manner substantially shown in FIG. 4, to the retaining ring member 14 through the opening 11*a* and then through the connector opening 14*a***.

With the conventional cathode ray tube so constructed as hereinabove described, the application of a predetermined voltage to individual electrodes of the electron gun assembly 13 and also the application of the high anode voltage of, for example, 20 to 30 Kv to the internal electroconductive coating 8 through the anode button 11 in the manner as hereinabove described, result in the eventual reproduction of a picture through the luminescent phosphor screen 5. During the operation of the cathode ray tube in this manner, it is well known that X-rays are generated inside the envelope 1 as electron beams radiated from the electron gun assembly 13 impinge upon the shadow mask 6 and the luminescent phosphor screen 5. This X-radiation emission is known to increase with an increase of the applied anode voltage. Leakage of the X-rays from the cathode ray tube to the surroundings results in a hazardous condition to which living bodies should not be exposed. Accordingly, protective counter-measures have hitherto been taken against the X-radiation emission from the cathode ray tube along with the implosion protection of the cathode ray tube.

FIG. 3 of the accompanying drawing illustrates a characteristic curve (generally known as a X-radiation dose limit curve) showing the relationship between the anode voltage at an anode current of 300 microamperes and the X-radiation dose rate. The characteristic curve corresponds to the maximum the X-ray radiation dose rate of 0.5 mR/H as recommended by ICRP (International Committee for Radiation Protection) from the cathode ray tube at a place 5 cm distant from the front face of the faceplate 2. This X-radiation dose limit curve is formulated by a cathode ray tube manufacturer and registered in EIAJ (Electronic Industry Association of Japan) as a guideline which television receiver manufacturers refer to in designing television receiver sets.

Referring still to FIG. 3, the X-ray radiation dose rate through the faceplate 2 is indicated by a line A. The X-ray radiation dose rate through the evacuated envelope 1 except the anode button 11 is indicated by a line B. The X-ray radiation dose rate through the anode button 11 is indicated by a line C. Comparing these lines A, B and C, it is clear that the X-ray radiation dose rate is greatest through the anode button 11. In other words, greater X-radiation emission is found through the anode button 11 than through any other portions of the evacuated envelope of the cathode ray tube.

In order to minimize the X-radiation emission from the anode button 11, various attempts have been made. One of them is shown in FIG. 4 and includes the use of a metallic shield plate 15, effective to shield X-rays, being welded in overlapping relation to the bottom 11*b* of the anode button 11. Another one is shown in FIG. 5 and includes the use of an anode cap 16, made of silicone rubber, for exteriorly covering the anode button 11, together with the use of a metallic shield plate 15 interposed between the anode button 11 and the anode cap 16. However, these prior art attempts have been found unsatisfactory as an effective countermeasure for the X-radiation prevention for various reason, for example, by reason of difficulty in quality control, i.e., for 100% guarantee.

Furthermore, the fabrication of the anode button 11 by the use of a press work and the installation of the metallic shield plate 15 in the anode button require complicated and time-consuming procedures. This is due to the fact that the anode button 11 is relatively minute in size having a relatively small diameter, for example, about 10 mm. Specifically, the greater the thickness of the metallic shield plate 15, the lower the X-radiation emission. However, because the size of the anode button 11 is very small as hereinabove described, the available thickness of the metallic shield plate 15, as well as that of the metal plate for the anode button 11, are limited. Accordingly, it is a conventional practice that the anode button, effective to minimize the X-radiation emission as low as possible, is difficult to make.

Some other attempts are disclosed in numerous publications such as, for example, U.S. Pat. No. 3,969,647 issued Jul. 13, 1976; the Japanese Patent Publication (Examined) No. 62-26141 published Jun. 6, 1987; and the Japanese Laid-open Utility Model Publications No. 49-22847 published in 1974, No. 52-21763 published in 1977, No. 52-91753 published in 1977, No. 53-70863 published in 1978 and No. 54-55258 published in 1979. However, all of these prior art attempts require a complicated structure rendering the manufacture difficult and expensive.

SUMMARY OF THE INVENTION

The present invention has been devised with the aim at substantially eliminating the problems inherent in the prior art anode buttons and is intended to provide a cathode ray tube employing an improved anode button effective to minimize the X-radiation emission taking place at and, in the vicinity of, the anode button.

In order to accomplish the above described object, the present invention herein disclosed, according to one preferred embodiment, provides a cathode ray tube comprising a highly evacuated envelope including a funnel section having one end closed by a faceplate and the opposite end continued to a generally tubular neck section. An internal electroconductive coating is applied to an inner surface of at least the funnel section, and an anode button is embedded in a mounting hole defined in the wall of the envelope forming the funnel section and having an opening defined therein for the insertion of a high voltage applying contact element therethrough.

In accordance with the present invention, the anode button embedded in the hole in the wall forming the funnel section has a wall area interiorly confronting the opening and inclined relative to a direction generally parallel to a portion of the envelope confronting the interior of the envelope in alignment with the mounting hole. The inclined wall area has at least a portion thereof held in electric contact with the internal electroconductive coating on the inner surface of the funnel section.

Preferably, the wall area of the anode button is so shaped as to represent a shape of an inverted cone having the apex portion oriented towards the interior of the envelope. Alternatively, the inclined wall area of the anode button is shaped so as to represent a shape of a cone having the apex portion protruding inwardly from the anode button and towards the outside of the envelope.

In another preferred embodiment of the present invention, the anode button has a circumferentially extending side wall representing a generally frustoconical shape having a large-diameter outer end and a reduced diameter inner end opposite to each other. It also has a bottom wall integral with the reduced diameter inner end, the bottom wall having a generally bevel-shaped cross-section with its converging point situated generally intermediate to the thickness of the wall forming the funnel section. In this embodiment, the converging point of the bottom wall may be either in alignment with, or radially outwardly offset from, the center of the bottom wall.

Alternatively, the bottom wall may be corrugated. In such case, a portion of the internal electroconductive coating which contacts the bottom wall may be similarly corrugated in complemental relation to the corrugated shape of the bottom wall.

In any event, the wall in the anode button, according to the present invention, presents a substantially increased effective thickness relative to the direction of travel of X-rays produced inside the envelope of the cathode ray tube and tending to leak through the anode button. Therefore, the X-radiation leakage can be effectively minimized.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the drawings, like reference numerals denote like parts in the several views, and:

DETAILED DESCRIPTION OF THE EMBODIMENTS

A cathode ray tube, of the present invention, comprises a highly evacuated envelope including a funnel section having one end closed by a faceplate and the opposite end continued to a generally tubular neck section. It further includes an electron gun assembly housed within the neck section and a luminescent phosphor screen formed on an inner surface of the faceplate in a predetermined pattern of primary color elemental phosphor deposits. A shadow mask is positioned inside the faceplate in a face-to-face relationship with the luminescent phosphor screen and has a predetermined pattern of apertures corresponding to a pattern of the primary color elemental phosphor deposits on the luminescent phosphor screen. Further, an internal electroconductive coating is applied to an inner surface of at least the funnel section, and an anode button is embedded in a mounting hole defined in the wall of the envelope forming the funnel section and connected electrically with the internal electroconductive coating.

Figure 6:
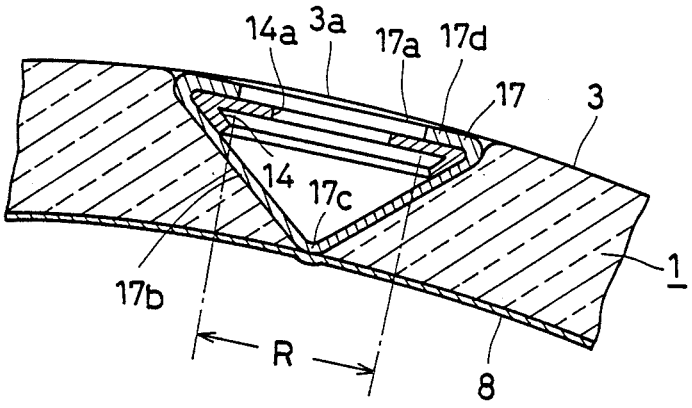
FIG. 6 is a longitudinal side sectional view of a portion of the cathode ray tube employing an anode button according to a first preferred embodiment of the present invention.
Figure 7:
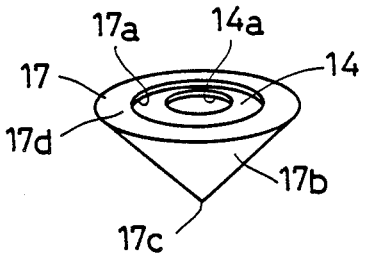
FIG. 7 is a perspective view of the anode button shown in FIG. 6.

With reference to FIGS. 6 and 7 showing the first preferred embodiment of the present invention, the wall forming a funnel section 3 has the mounting hole 3*a* of a cross-sectional shape as will be described later. The anode button, according to the illustrated embodiment, is generally identified by 17. This anode button 17 is made of an Fe—Ni—Cr (iron-nickel-chromium) alloy and is snugly inserted and held firmly in position within the mounting hole 3*a*.

The illustrated anode button 17 is of a generally conical shape having an apex portion 17*c* representing a generally acute angle, a circumferentially extending side wall 17*b* flared outwardly from the apex portion 17*c* and a radially inwardly extending annular flange 17*d* that leaves an opening defined at 17*a*. Specifically, the side wall 17*b* is inclined so as to form an angle of $\alpha°$ (See FIG. 9) relative to that portion of the wall of the funnel section 3 which surrounds the mounting hole 3*a*.

As is the case with the prior art anode button, the retaining ring member 14 has the opening 14*a* through which the forked contact element 12 (FIG. 1) is inserted for electrical connection therewith. It is positioned inside the anode button 17 and firmly interlocked therewith in a known manner.

Figure 1:
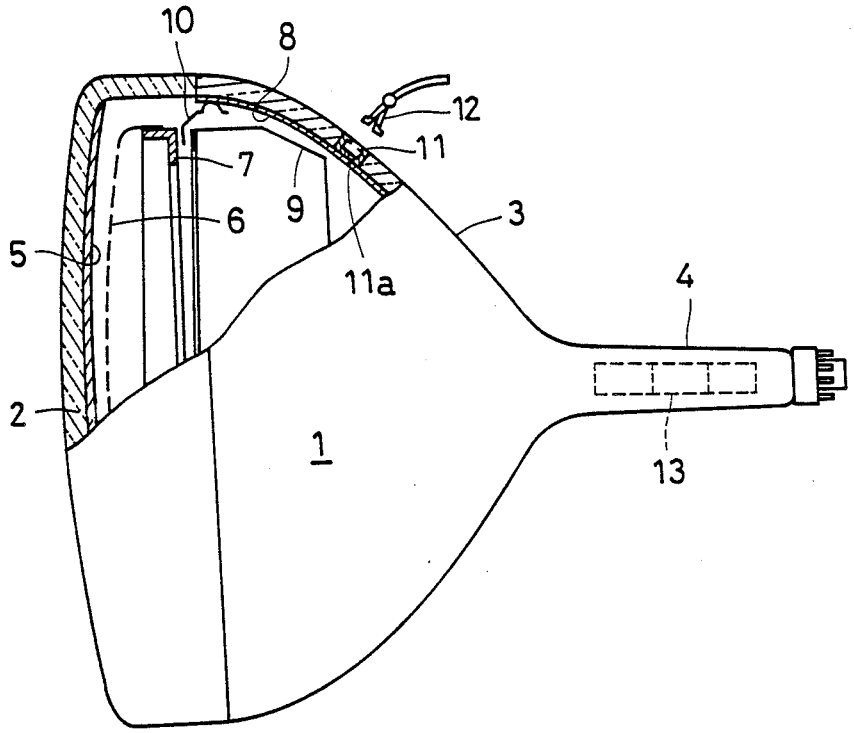
Fig. 1 Prior Art
FIG. 1 is a longitudinal side view, with a portion cut away, of the prior art cathode ray tube.

In view of the anode button 17 being of a generally conical shape and, more specifically, of a shape generally similar to the shape of an inverted cone as viewed in FIGS. 6 and 7, the mounting hole 3*a* defined in the wall of the funnel section 3 configured so as to have the diameter progressively decreasing in a direction from the outside towards the inside of the envelope 1 (FIG. 1). This is so that, when the anode button 17 is inserted into the mounting hole 3*a* with the apex portion 17*c* oriented towards the interior of the cathode ray tube, the apex portion 17*c* of the anode button 17 can contact, in a generally point-to-point contact fashion, the internal electroconductive coating. This is establishes a firm and reliable electric circuit between the anode button 17 and the internal electroconductive coating 8. The inner half of the side wall is in a position interiorly confronting the opening 17*a*, or in a position distant inwardly of the funnel section 3 from the opening 17*a* and confronting the opening 17*a* in a direction from the inside towards the outside of the funnel section 3, through which opening 17*a* most X-rays leak. That position is confined in the region R shown in FIG. 6. With the anode button 17 so mounted in the mounting hole 3*a*, the annular flange 17*d* may be positioned generally flush with an outer surface of the funnel section 3, or it may either be set back or set so as to protrude a slight distance outwardly therefrom.

The function of the anode button 17, according to the embodiment shown in and described with reference to FIGS. 6 and 7, will now be discussed with the aid of FIGS. 8 to 10.

Figure 2:
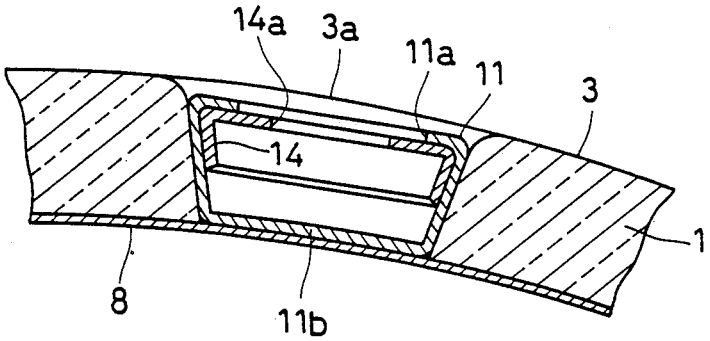
Fig. 2 Prior Art
FIG. 2 is a longitudinal side-sectional view, on an enlarged scale, of a portion of the cathode ray tube of FIG. 1, showing the details of an anode button employed therein.
Figure 3:
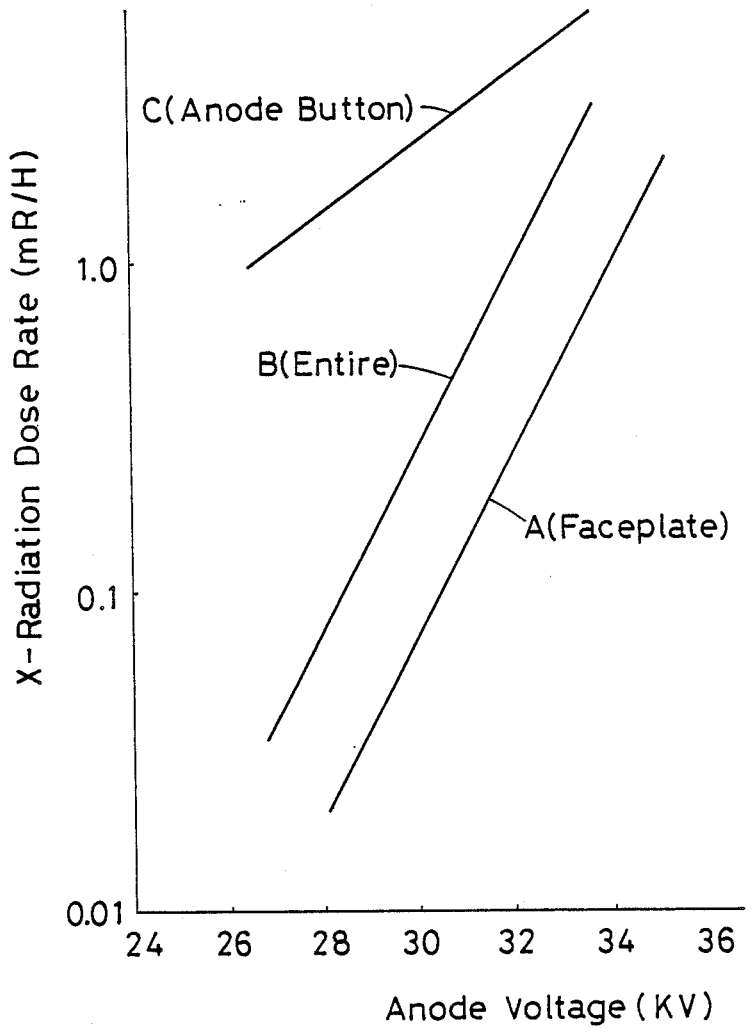
FIG. 3 is a graph showing the relationship between the applied anode voltage and the X-ray radiation dose rates through several portions in the prior art cathode ray tube.
Figure 4:
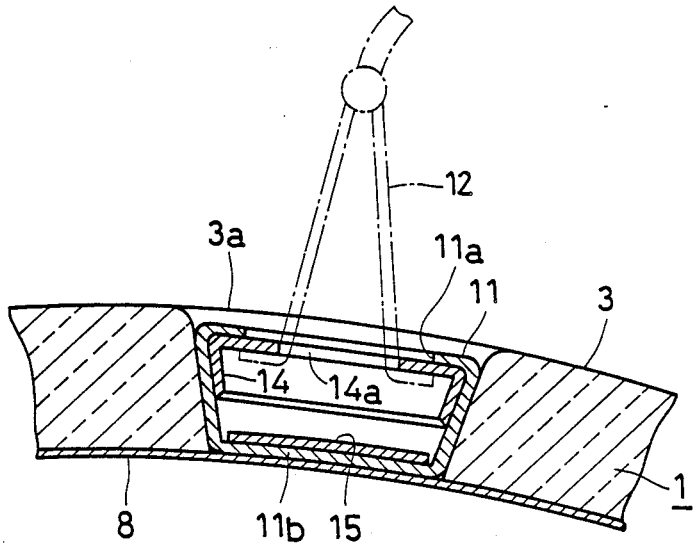
Fig. 4 Prior Art
FIGS. 4 and 5 are views similar to FIG. 2, showing the different prior art anode buttons, respectively.
Figure 5:
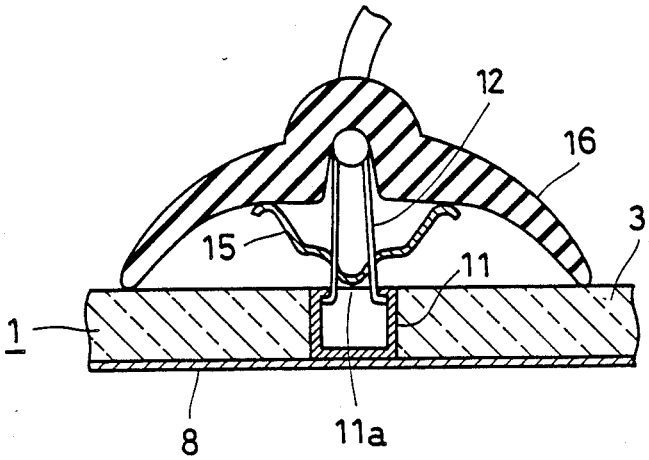
Fig. 5 Prior Art
Figure 8:
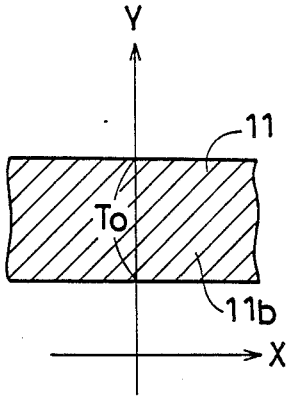
Fig. 8 Prior Art
FIGS. 8 and 9 are side sectional views, on an enlarged scale, of a portion of the wall forming the prior art anode button and of a portion of a corresponding wall forming the anode button of FIG. 6, respectively, which views are used to demonstrate the difference in effective thickness of the wall in a direction of the thickness of the wall forming a funnel section of the cathode ray tube.

FIG. 8 illustrates, on an exaggerated scale, a portion of the bottom wall 11*b* of the prior art anode button 11 shown in and discussed with reference to FIGS. 1 and 2. For the purpose of comparison, the bottom wall 11*b* is shown as lying horizontal, specifically parallel to an X-axis direction which lies in a direction generally parallel to a portion of the wall of the funnel section in the vicinity of the mounting hole 3*a*. This X-axis direction is perpendicular to the longitudinal axis of the mounting hole 3*a* and also to an Y-axis direction which lies in a direction across the thickness of the wall forming the funnel section 3. This direction may be considered the direction in which X-rays inside the envelope 1 travel through the anode button 11.

Figure 9:
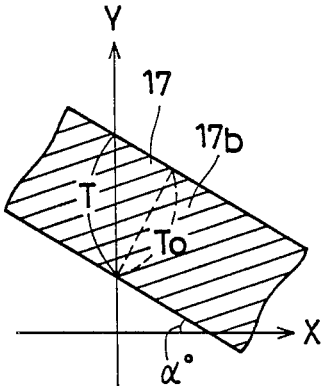

While the effective thickness of the wall in the prior art anode button 11 which lies in the Y-axis direction, indicated by To, is represented by the wall of the bottom wall 11*b* itself, the wall in the anode button 17 of the present invention, which lies in the same Y-axis direction, because the side wall 17*b* is inclined at an angle of $\alpha°$ relative to the X-axis direction as shown in FIG. 9, represents an effective thickness indicated by T. The effective thickness T is substantially greater than the thickness To. It is to be noted that the term "effective thickness" used hereinbefore and hereinafter is intended to mean the thickness of the wall as measured in the Y-axis direction. In other words, it refers to the direction in which the X-rays produced inside the envelope of the cathode rays tend to leak to the outside of the envelope, through the anode button.

The fact that the effective thickness T of the wall of the anode button 17, as measured in a direction across the thickness of the wall of the funnel section 3, is relatively greater than the effective thickness To of the wall of the prior art anode button, as measured in the same direction, implies that the X-rays tending to leak outside the cathode ray tube through the mounting hole 3*a* can be more effectively shielded with the anode button 17 of the present invention, than the anode button 11 of the prior art. More specifically, because the side wall 17*b* of the greater thickness interiorly confronts the opening 17*a* through which most X-rays leak, an effective shielding of the X-rays can be attained.

Figure 10:
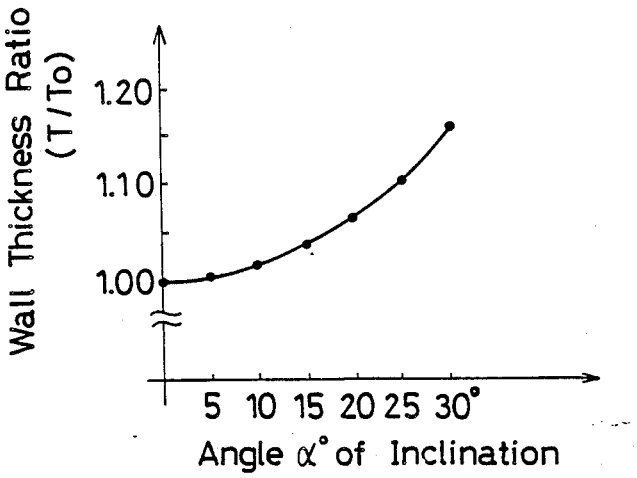
FIG. 10 is a graph used to evaluate the difference in thickness of the anode button in association with FIGS. 8 and 9.

FIG. 10 is a graph showing the relationship between the angle $\alpha°$ of inclination of the wall of the anode button, taken on the abscissa axis of, and the ratio of the thickness T relative to the thickness To taken on the ordinate axis, the ratio of T/To being equal to $1/\cos\alpha$. The graph of FIG. 10 illustrates that the increase of the angle $\alpha°$ of inclination brings about an increase of the ratio of T/To. Therefore an increase in effective thickness of the wall of the anode button, which lies generally perpendicular to that portion of the wall of the funnel section in the vicinity of the mounting hole 3*a*, is achieved. The greater the effective thickness of the wall of the anode button traversing the longitudinal axis of the mounting hole 3*a*, the more minimized the X-radiation leakage.

Figure 11:
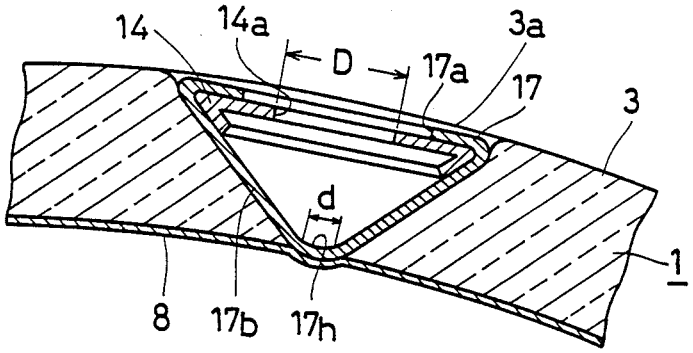
FIGS. 11 and 12 are views similar to FIGS. 6 and 7, respectively, showing the anode button according to another preferred embodiment of the present invention.
Figure 12:
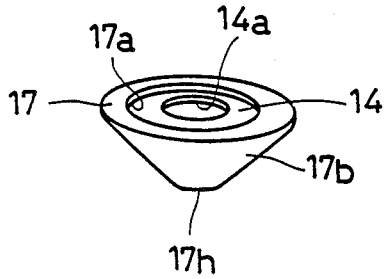

FIGS. 11 and 12 show a second preferred embodiment of the present invention. The anode button shown therein differs from the anode button of the foregoing embodiment in that, while the apex portion 17*c* of the anode button 17 of the foregoing embodiment represents a generally acute angle, the apex portion of the anode button shown in FIGS. 11 and 12 has a circular flank 17*d* of a diameter d smaller than the diameter, shown by D, of the opening 14*a* defined in the retaining ring member 14. Consequently, it is smaller than the diameter of the opening 17*a* of the anode button 17. This is for establishing a face-to-face contact between the anode button 17 and the internal electroconductive coating 8.

Applying the discussion made with reference to FIGS. 8 to 10 to the second preferred embodiment of the present invention, it will be seen that the employment of the circular flank 17*h* at the apex portion of the anode button 17 may reduce the thickness of the wall of the anode button 17 traversing the longitudinal axis of the mounting hole 3*a*. However, because the diameter d of the circular flank 17*h* is chosen to be smaller than the diameter D of the opening 14*a* in the retaining ring member 14 accommodated within the anode button 17 as hereinbefore described, the X-radiation emission can be minimized as compared with that afforded by the prior art anode button 11 shown in FIGS. 1 and 2.

In third to sixth embodiments of the present invention shown in FIGS. 13 to 16, respectively, the anode button 17 comprises a circumferentially extending side wall 17*b* flared outwardly in a direction from the internal electroconductive coating 8 towards the outside of the envelope. The side wall 17*b* has a large-diameter end, or an outer end, and a reduced-diameter end, or an inner end. Those ends are opposite to each other and are positioned adjacent and remote from the internal electroconductive coating 8, respectively. The wall also has a radially inwardly extending flange 17*d* leaving the opening 17*a*.

The anode button 17 shown in any one of FIGS. 13 to 16 also comprises a generally bevel-shaped bottom wall 17*e* having its peripheral edge integral with the reduced-diameter end of the side wall 17*b*, so that an apex portion 17*f* or a center portion of the bevel-shaped bottom wall 17*e* can be positioned generally intermediate the thickness of the wall of the funnel section 3. In other words, the bottom wall 17*e* is so shaped as to have the apex portion 17*f* of the anode button 17 protruding inwardly and towards the outside of the envelope of the cathode ray tube.

That portion of the internal electroconductive coating 8, which aligns with the bottom wall 17*e*, is correspondingly beveled to follow the shape of the bottom wall 17*e*, while electrically connected thereto.

As is the case with the prior art anode button, the retaining ring member 14, having the opening 14*a* through which the forked contact element 12 (FIG. 1) is inserted for electrical connection therewith, is positioned inside the anode button 17 and firmly interlocked therewith in any known manner.

While the anode button 17 according to any one of the embodiments of FIGS. 13 to 16 is so constructed as hereinabove described, how the third to sixth embodiments differ from each other will now be described.

Figure 13:
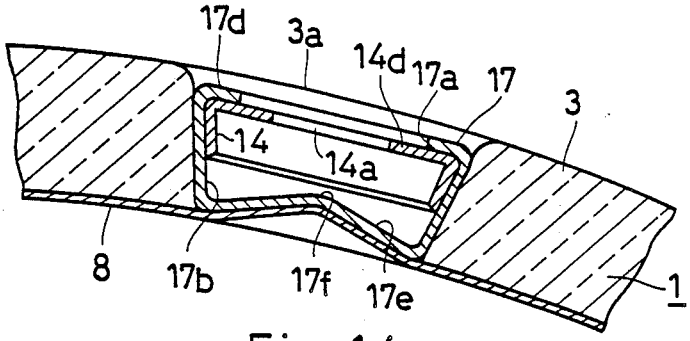
FIGS. 13 to 17 are views similar to FIG. 6, showing third to seventh preferred embodiments of the present invention, respectively.

In the third embodiment shown in FIG. 13, the apex portion 17*f* is in coaxial relationship with the mounting hole 3*a* and also with the opening 17*a*.

Figure 14:
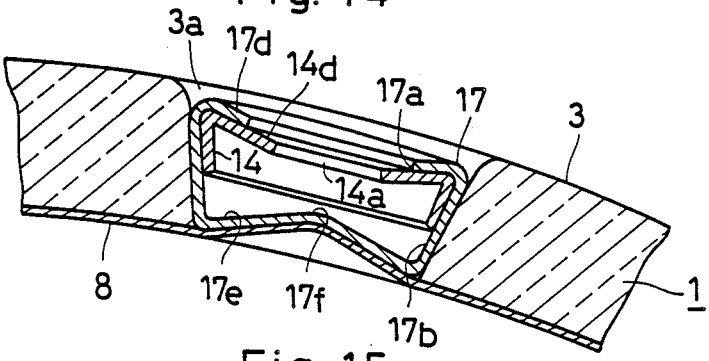

In the fourth embodiment shown in FIG. 14, both the radially inwardly extending flange 17*d* around the opening 17*a*, and a similarly radially inwardly extending flange 14*d* of the retaining ring member 14 around the opening 14*a*, are inclined so as to converge at a point generally intermediate the thickness of the wall of the funnel section 3.

Figure 15:
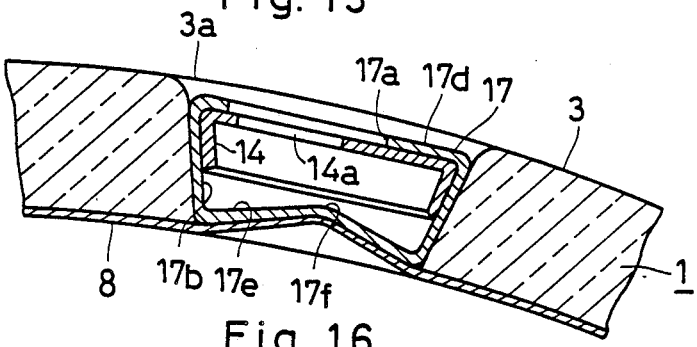

In the fifth embodiment shown in FIG. 15, both of the openings 17*a*, 14*a* in the anode button 17 and the retaining ring member 14 are offset laterally with respect to the longitudinal axis of the mounting hole 3*a* in the wall of the funnel section 3, and also with respect to the apex portion 17*f* of the bottom wall 17*e*.

Figure 16:
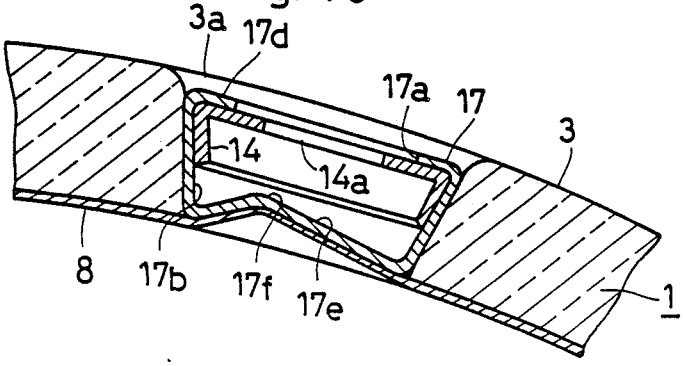

In the sixth embodiment shown in FIG. 16, the apex portion 17*f* in the bottom wall 17*e* is offset laterally with respect to the longitudinal axis of the mounting hole 3*a* in the wall of the funnel section 3 and also with respect to the center of any one of the opening 17*a* of the anode button 17 and the opening 14*a* of the retaining ring member 14.

Even in any one of the respective embodiments of FIGS. 13 to 16, the wall of the anode button 17 traversing the longitudinal axis of the mounting hole 3*a* is inclined relative to the wall of the funnel section 3. This is similar to the case with that of the anode button 17 according to the first and second embodiments shown in FIGS. 6 and 7 and FIGS. 11 and 12, respectively. Therefore, the description similar to that made with reference to FIGS. 8 to 10, can be equally applicable to any one of the third to sixth embodiments of FIGS. 13 to 16.

Figure 17:
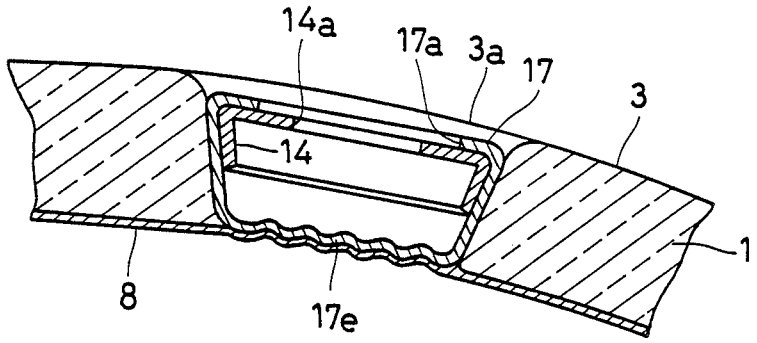

Shown in FIG. 17 is the anode button according to the seventh preferred embodiment of the present invention. The anode button 17 shown in FIG. 17 is generally similar to the prior art anode button 11 shown in FIGS. 1 and 2. However, the anode button 17 of FIG. 17 differs from the prior art anode button 11 in that, while the bottom wall 11*b* of the anode button shown in FIGS. 1 and 2 is substantially flat, the bottom wall 17*e* of the anode button 17 shown in FIG. 17 is corrugated. This is to provide a multiple of inclined wall portions traversing the longitudinal axis of the mounting hole 3*a*.

So far shown in FIG. 17, that portion of the internal electroconductive coating 8 which is in contact with the bottom will 17*e* is shown as correspondingly corrugated. It is, however, to be noted that that portion of the internal electroconductive coating 8 may not be corrugated to follow the corrugations of the bottom wall 17*e* and may contact the corrugated bottom wall 17*e* in a line contact fashion.

From the foregoing description, the present invention can provide an advantage in minimizing the X-radiation emission through the anode button in the cathode ray tube. More specifically, the anode button, according to the present invention, has a wall area inclined relative to the wall forming the funnel section with at least a portion of the wall area held in electric contact with the internal electroconductive coating formed on the inner surface of the funnel section. Accordingly, X-rays produced inside the envelope of the cathode ray tube and tending to leak to the outside of the envelope through the anode button, can be effectively shielded because of the substantially increased effective thickness of the wall area as measured in the direction in which the X-rays travel through the anode button.

Although the present invention has fully been described in connection with the preferred embodiments thereof with reference to the accompanying drawings used only for the purpose of illustration, those skilled in the art will readily conceive numerous changes and modifications within the framework of obviousness upon the reading with regard to the specification herein presented of the present invention. For example, in the first to sixth embodiments shown in FIGS. 6, 7 and 11 to 16, the anode button may contact the internal electroconductive coating 8 in a line contact fashion, instead of the point-to-point contact fashion or the face-to-face contact fashion shown therein.

Accordingly, such changes and modifications are, unless they depart from the spirit and scope of the present invention as delivered from the claims annexede hereto, to be construed as included therein.

Further, it is noted that the present invention can be applicable to black and white cathode ray tubes.

What is claimed is:

1. A cathode ray tube which comprises:

a highly evacuated envelope including a funnel section having one end closed by a faceplate and the opposite end continued to a generally tubular neck section, said funnel section having a mounting hole defined therein completely through the thickness of a wall thereof;

an internal electroconductive coating applied to an inner surface of at least the funnel section; and an anode button embedded in the mounting hole, having an opening defined therein for the insertion of a high voltage applying contact element therethrough and, containing a wall area extending from said opening, continuously surrounding the perimeter of said anode button;

said wall area being inclined relative to a direction generally parallel to a portion of the envelope confronting the interior of the envelope in alignment with the mounting hole, said inclined wall area being in a position interiorly confronting the opening and having at least a portion thereof held in electric contact with the internal electroconductive coating on the inner surface of the funnel section.

2. The cathode ray tube as claimed in claim 1, wherein the inclined wall area of the anode button is so shaped as to represent a shape similar to the shape of an inverted cone having the apex portion oriented towards the interior of the envelope.

3. The cathode ray tube as claimed in claim 1, wherein the inclined wall area of the anode button is so shaped as to represent a shape similar to the shape of a cone having the apex portion of the conical shape protruding inwardly towards the opening of the anode button.

4. The cathode ray tube as claimed in claim 1, wherein said anode button is made of an Fe-Ni-Cr alloy.

5. The cathode ray tube as claimed in claim 2, wherein said portion of the wall area contacting said internal electroconductive coating forms a sharp apex of the shape of the inverted cone.

6. The cathode ray tube as claimed in claim 2, wherein said portion of the wall area has a flank region.

7. A cathode ray tube which comprises:

a highly evacuated envelope including a funnel section having one end closed by a faceplate and the opposite end continued to a generally tubular neck section, said funnel section having a mounting hole defined therein completely through the thickness of a wall thereof;

an electron gun assembly housed within the neck section;

a luminescent phosphor screen formed on an inner surface of the faceplate in a predetermined pattern of phosphor deposits;

an internal electroconductive coating applied to an inner surface of at least the funnel section; and an anode button having a contact area and an opening defined therein, for the insertion of a high voltage applying contact element therethrough, said anode button comprising a continuous circumferentially extending side wall through the contact area and flared outwardly from the contact area towards the opening, said anode button being embedded in the mounting hole with the contact area of the wall held in electric contact with the internal electroconductive coating, said contact area of said wall having a surface area of said wall smaller than the surface area of the opening.

8. The cathode ray tube as claimed in claim 7, wherein said anode button represents a generally conical shape having an apex occupied by the contact area.

9. The cathode ray tube as claimed in claim 7, wherein said anode button represents a generally frustoconical shape having a large-diameter end and a reduced-diameter end opposite to each other, said reduced diameter end being occupied by the contact area.

10. The cathode ray tube as claimed in claim 7, further comprising a retaining ring member secured inside and to the side wall of the anode button for the engagement with the high voltage applying contact element, said retaining ring member having defined therein an opening which is smaller than the opening in the anode button.

11. A cathode ray tube which comprises:

a highly evacuated envelope including a funnel section having one end closed by a faceplate and the opposite end continued to a generally tubular neck section, said funnel section having a mounting hole defined therein completely through the thickness of a wall thereof;

an electron gun assembly housed within the neck section;

a luminescent phosphor screen formed on an inner surface of the faceplate in a predetermined pattern of phosphor deposits;

an internal electroconductive coating applied to an inner surface of at least the funnel section; and an anode button having an outer end and an inner end and an opening defined in the outer end thereof for the insertion of a high voltage applying contact element therethrough, said anode button including a circumferentially extending side wall inclined from the outer end and continuously through a bottom wall of the inner end, the bottom wall having a peripheral edge integrally formed with the inner end, with a center portion of the bottom wall peaked outwardly from the envelope of the peripheral edge toward said outer end, said anode button being embedded in the mounting hole with the bottom wall held in electric contact with the internal electroconductive coating.

12. The cathode ray tube as claimed in claim 11, wherein the bottom wall has a bevel-shaped portion between the center portion and the peripheral edge.

13. The cathode ray tube as claimed in claim 11, wherein the opening in the outer end of the circumferentially extending side wall is defined by an annular flange extending radially inwardly from outer end, said annular flange being inclined relative to the side wall so as to protrude inwardly from the side wall.

14. The cathode ray tube as claimed in claim 11, further comprising a retaining ring member secured inside and to the side wall of the anode button for the engagement with the high voltage applying contact element, said retaining ring member having defined therein an opening which is smaller than the opening in the outer end of the anode button.

15. A cathode ray tube which comprises:

a highly evacuated envelope including a funnel section having one end closed by a faceplate and the opposite end continued to a generally tubular neck section, said funnel section having a mounting hole defined therein completely through the thickness of a wall thereof;

an electron gun assembly housed within the neck section;

a luminescent phosphor screen formed on an inner surface of the faceplate in a predetermined pattern of phosphor deposits;

an internal electroconductive coating applied to an inner surface of at least the funnel section; and an anode button having an outer end and an inner end and an opening defined in the outer end thereof for the insertion of a high voltage applying contact element therethrough, said anode button comprising a circumferentially extending side wall having the outer end and the inner end therein, and continuously extending through a bottom wall, which is generally corrugated to increase the effective thickness of the wall for shielding X-ray emmission from said envelope, and integrally formed with the inner end, said anode button being embedded in the mounting hole with the bottom wall held in electric contact with the internal electroconductive coating.

16. The cathode ray tube as claimed in claim 15, further comprising a retaining ring member secured inside and to the side wall of the anode button for the engagement with the high voltage applying contact element, said retaining ring member having defined therein an opening which is smaller than the opening in the outer end of the anode button.

17. A cathode ray tube comprising:

a highly evacuated envelope of a funnel shape, said envelope having a mounting hole defined therein extending completely through a wall thereof;

an internal electrically conductive coating applied to an inner surface of at least a portion of said envelope; and an anode button, conical in shape with an opening at the base of said conical shape, containing an electrically conductive wall circumferentially surrounding said conical shape, said anode button containing said opening for insertion of a high voltage applying contact element therein, which then contacts said electrically conductive wall to supply voltage to said internal electrically conductive coating through an electrical contact of said electrically conductive wall and said electrically conductive coating, at the apex of said conical shape.

18. A cathode ray tube, as claimed in claim 17, wherein said electrically conductive wall is in contact with said internal electrically conductive coating at said apex of said conical shape, the remainder of said electrically conductive wall not being in contact and inclined at a relative angle to the internal electrically conductive coating to thereby provide an effective thickness, greater than the thickness of said electrically conductive wall, which shields X-ray emission from said highly evacuated envelope of said cathode ray tube.

19. A cathode ray tube, having a highly evacuated envelope of a funnel shape, with a faceplace and phosphor screen at a wide end of the funnel shape and an electron gun assembly at the opposite, generally tubular end of the funnel shape, the envelope having a mounting tube therein, said cathode ray tube comprising:

an internal electroconductive coating applied to an inner surface of the envelope;

an anode button, of an inverted conical shape, embedded in said mounting hole and containing an opening defined at the base of said conical shape for the insertion of a high voltage applying contact element therethrough;

said anode button containing an electrically conductive wall continually extending from said opening through the apex of said conical shape, thereby surrounding the perimeter of said conical shape, said electrically conductive wall contacting said internal electroconductive coating at said apex of said conical shape, thereby establishing, in the remainder of said electrically conductive wall inclined at an angle relative to said internal electroconductive coating, an effective thickness, greater than the true thickness of said electrically conductive wall, for shielding X-rays from being emitted from said cathode ray tube.

20. A cathode ray tube, as claimed in claim 19, wherein said anode button is made of an Fe-Ni-Cr alloy.

21. A cathode ray tube, as claimed in claim 19, further comprising:

a retaining ring member, connected to said electrically conductive wall of said anode button, for defining an opening smaller than that of said anode button to thus retain engagement of said high voltage applying contact element upon insertion into said anode button opening.

22. A cathode ray tube, having a highly evacuated envelope of a funnel shape, with a faceplate and phosphor screen at a wide end of the funnel shape and an electron gun assembly at the opposite, generally tubular end of the funnel shape, the envelope having a mounting hole therein, said cathode ray tube comprising:

an internal electroconductive coating applied to an inner surface of the envelope;

an anode button, of an inverted conical shape, embedded in said mounting hole and containing an opening defined at the base of said conical shape for the insertion of a first high voltage applying contact element therethrough;

said anode button containing an electrical conductive wall continually extending from said opening through the apex of said conical shape, thereby surrounding the perimeter of said conical shape, said electrically conductive wall contacting said internal electroconductive coating at said apex of said conical shape to thus transfer voltage of a first level, applied from said first high voltage applying contact element, to an anode of said cathode ray tube; and a cathode high voltage source, connected to said electron gun assembly, for externally applying voltage of a second level to a cathode of said cathode ray tube, said cathode high voltage source being different from said first high voltage contact element.

* * * * *